United States Patent [19]

Charlier

[11] 4,264,900

[45] Apr. 28, 1981

[54] PRE-DROPPING WARNING DEVICE

[76] Inventor: Andre A. Charlier, La Moldt, 4560 Warsage, Dalhem, Belgium

[21] Appl. No.: 112,921

[22] Filed: Jan. 17, 1980

[30] Foreign Application Priority Data

Jan. 18, 1979 [BE] Belgium ..... 6/46736

[51] Int. Cl.[3] ..... G08B 21/00

[52] U.S. Cl. ..... 340/573; 340/539; 119/1

[58] Field of Search ..... 340/539, 573, 571; 128/630; 119/1

[56] References Cited

U.S. PATENT DOCUMENTS 4,028,687 6/1977 Hamaguchi et al. ..... 340/573

*Primary Examiner*—Alvin H. Waring

*Attorney, Agent, or Firm*—Young & Thompson

[57] ABSTRACT

A device to detect and signal the moment when a beast prepares to give birth. A container having fastening means for attachment on the behind of the beast is connected at its upper part to a tube extending so that its free end can be introduced into the vagina of the beast beyond the urethra. In the lower part of the container there emerges a tube of small diameter which is connected to a pressure sensor connected in the electrical circuit of an alarm device for producing an actuating signal for said alarm device in response to an increase of pressure in the container. In this way, an alarm is given as soon as from the breaking of the allantoic and amniotic sacs of the beast. The device further is arranged to monitor the subsequent development of the dropping.

5 Claims, 5 Drawing Figures

PRE-DROPPING WARNING DEVICE

BACKGROUND OF THE INVENTION

The present invention is concerned with a device to detect and signal the moment when a beast, e.g. a cow or a horse, prepares to give birth.

A dropping warning device which detects and signals the start of the passage of a young animal through the vagina of its mother is known. This appliance comprises substantially a support adaptable to the behind of a beast, on which an abutment arranged opposite the vagina of the beast is mounted. This abutment is mounted so as to be displaced by the young animal at the start of its emergence from the vagina in order to interact with a contactor connected to the electrical circuit of an alarm device. This appliance, although enabling the start of the dropping to be detected, nevertheless does not make it possible to know at what moment the beast prepares to give birth and when it loses the waters from its allantoic and amniotic sacs. However, this moment is very important e.g. for certain cows which must be delivered on time, that is very little time before the breaking of the sacs on pain of running the risk of losing the beast and its young. Detecting the moment of the breaking of the sacs is likewise very important for certain animal species, e.g. cows with a foal-like rump which cannot calve or in the case where the calf does not present itself. To detect the breaking of the water sacs, there is known an appliance having a probe of the urinary type intended to be introduced between the lips of the vulva of the beast into its vagina so as to collect the waters of the allantoic and amniotic sacs. This probe contains two electrodes which are moistened by the waters upon the breaking of the sacs and there results therefrom between the electrodes a variation of electrical resistance which brings about the release of an alarm. It has been established that this appliance produces untimely alarms due in all probability to variations of the state of humidity or to the presence of mucus rejected by the beast. On the other hand, although this appliance is intended to detect the breaking of the water sacs, it does not enable the actual start of the dropping to be detected subsequently.

SUMMARY OF THE INVENTION

The problem which the invention aims to solve is to provide a device capable of detecting and signalling in a safe manner and without untimely alarms the moment when a beast prepares to give birth, said device also being capable of monitoring the subsequent development of the dropping.

The invention solves the problem with a device of simple construction specially designed to detect and signal the moment when a beast loses its waters as well as the moment when the dropping actually starts. The characteristics of this device are described in the claims.

The advantage of the warning device according to the invention is that it detects parturition with safety and accuracy as soon as it begins, thus making it possible to check the length of preparation of the opening of the neck of the uterus, and that it then signals the start of the second phase of the mechanism, thus ensuring a total safety intended to reduce completely the risks of losses of high-quality beasts. Another advantage of the appliance according to the invention is that it permits the dropping, even with the appliance in position on the beast.

BRIEF DESCRIPTION OF THE DRAWINGS

The invention is described hereinafter with reference to the attached drawings wherein.

In the various drawings the same reference numerals designate identical elements or elements having equivalent functions.

DESCRIPTION OF EXEMPLARY EMBODIMENTS

Figure 1:
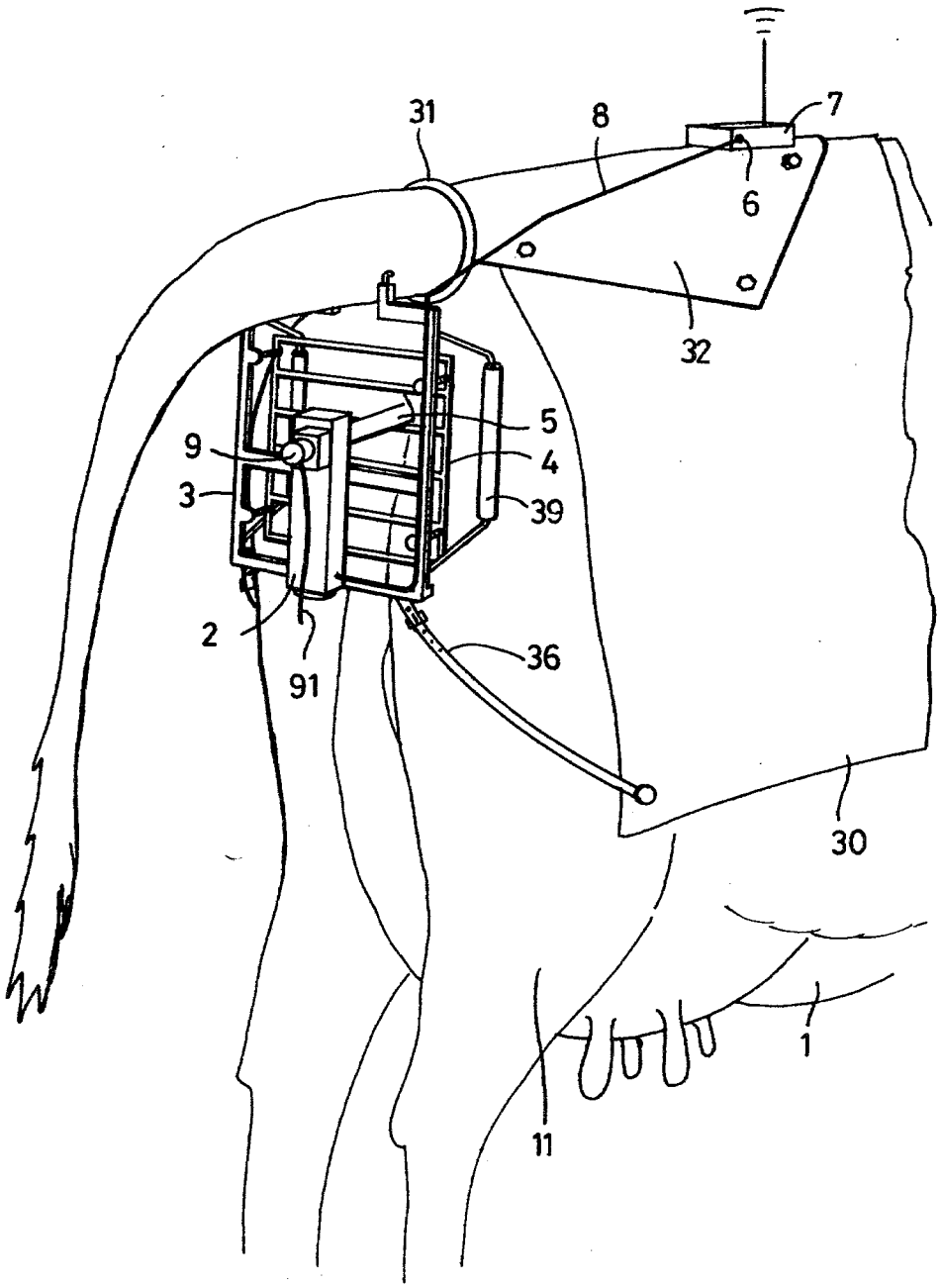
FIG. 1 shows the arrangement of a pre-dropping warning device according to the invention placed in position on a cow.

FIG. 1 illustrates an embodiment of the device according to the invention placed in position on a cow 1. The device 10 comprises substantially a container 2 attached to a support 3 held suspended opposite the vagina of the beast 1 and on which there are likewise mounted a moving abutment 4, a tube 5 having one end intended to be introduced into the vagina of the beast and a pressure sensor 6 connected to an alarm device 7 placed on the back of the beast 1.

The support 3 is constituted here by a grid suspended on the beast and which bears against the behind of said beast by means of two arms 39. The abutment 4 is mounted on stems 43 fixed to the support 3 and which enable it to be displaced by translation in relation to the support 3. Helical springs 44 surround the stems 43 and hold the abutment 4 in its normal position, the abutment 4 being retained at the end of the stems 43 by stop bolts 45 screwed to the threaded ends of the guide stems. Any pressure against the abutment 4 is therefore converted into a translation of said abutment 4 parallel to itself and to the support 3 against the action of the helical springs 44.

Attached to the support 3 is a container 2 intended to collect the waters from the allantoic and amniotic sacs. This container may have any form whatever and be constituted by any material whatever. Connected to the upper part of the container 2 is a tube 5 e.g. of rubber, extending so that its free end can be introduced into the vagina of the beast beyond the urethra. The container 2 thus collects the dropping waters without collecting the urine. The length of the tube 5 may be e.g. 15 to 28 cm and its diameter may be e.g. 1 to 3 cm depending on the beasts to which it is to be adapted. The container 2 must have a volume sufficient to ensure a safe and stable operation, e.g. of the order of 300 to 500 $cm^3$. It has been established, in fact, that a beast can reject up to about 250 $cm^3$ of mucus in one night, which would prevent a container of insufficient volume from collecting the water from the sacs and therefore from signalling the breaking thereof. In the lower part of the container 2 there emerges a tube of small diameter 8, e.g. of rubber. The other end of the tube 8 is connected to the pressure sensor 6 connected in the electrical circuit of the alarm device 7 placed on the back of the beast. The device composed of the elements 2, 5 and 6 operates as follows. When the first contractions of the beast begin, the air expelled via the tube 5 produces in the container 2 an increase of pressure which is transmitted to the pressure sensor 6 by means of the tube 8. The first waters collected in the container 2 likewise produce a pressure which actuates the pressure sensor 6. This sensor thus detects in this device any increase of pressure in the container 2 and can therefore then release the alarm device 7. The latter may be any signalling or alarm device whatever, e.g. an acoustic device or even a small radio-frequency transmitter which enables the livestock to be monitored at a larger distance.

The tube 5 is formed with a hole 51 in its wall to enable the dropping waters to be introduced when the mouth 52 of the tube 5 is obstructed.

Figure 2:
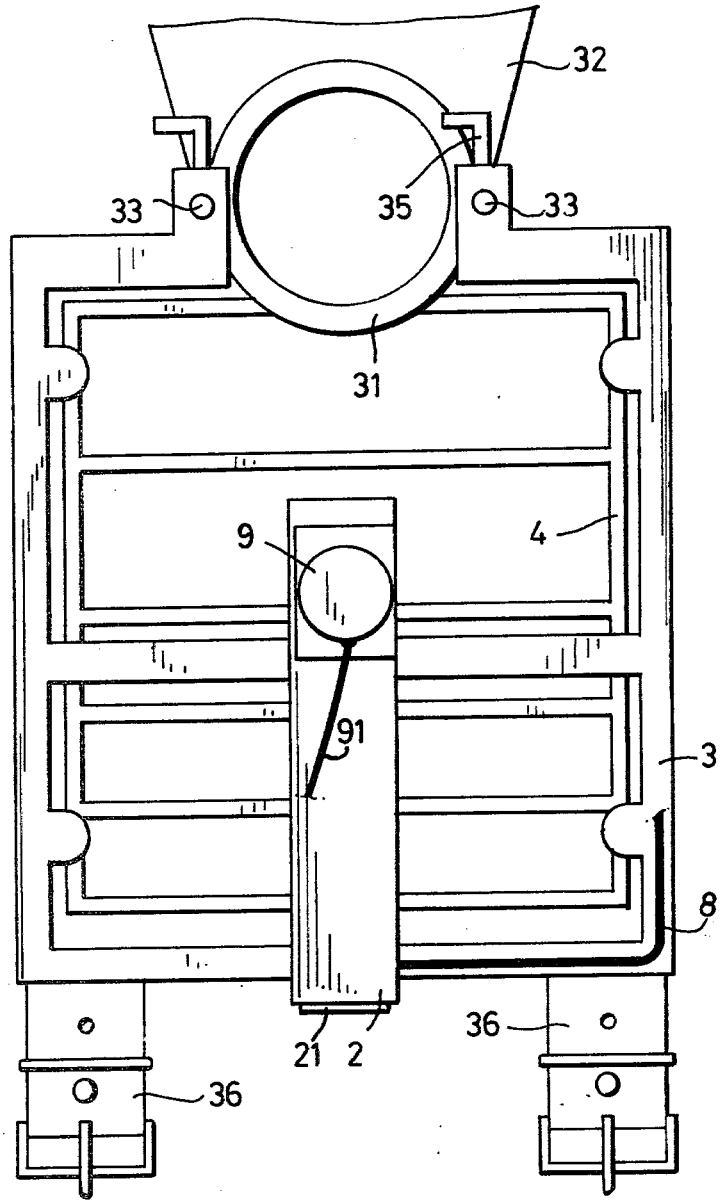
FIG. 2 is front elevation of an embodiment of the warning device shown in FIG. 1.
Figure 3:
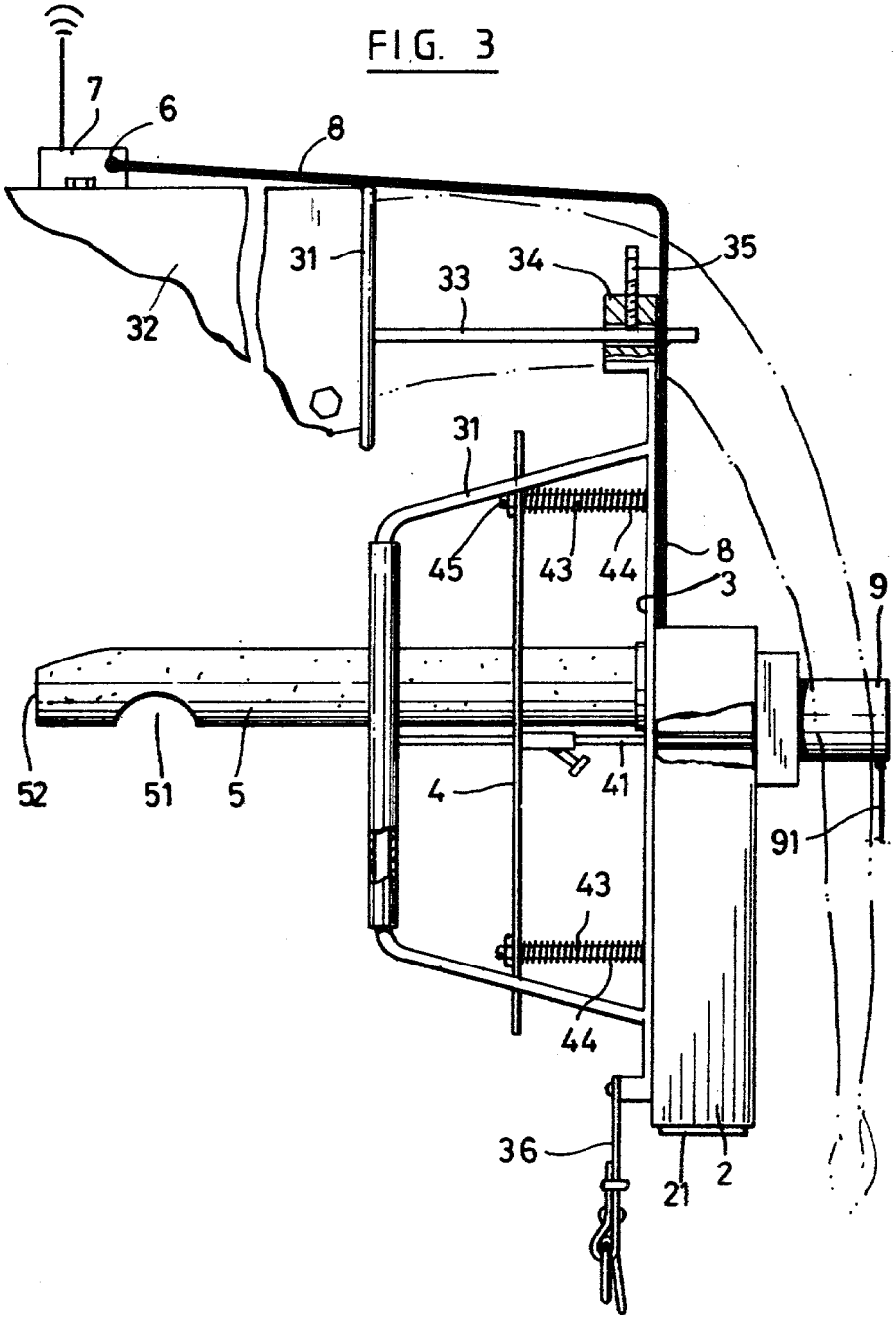
FIG. 3 is a side elevation of the device shown in FIG. 2.

The device according to the invention may be fixed to the beast by any harnessing system whatever. In the embodiment illustrated in FIGS. 1 to 3 the support 3 is suspended on a ring 31 fixed to an apron 32 having the form of the back of the beast to enable it to be put in place thereon. The apron 32 is fixed to a blanket 30. The opening of the ring 31 allows passage for the tail of the beast. The support 3 is linked to the ring 31 by means of a double arm 33 whose ends are clamped in collars 34 integral with the support via screws 35. In this way, the spacing of the ring 31 in relation to the plane of the support 3 can be adjusted for each beast. The support 3 is held firmly in place by straps 36 gripping the buttocks 11 of the beast and attached to the blanket 30. Owing to this method of suspension the beast can lie down on its side and the appliance is still placed in the extension of the back and positioned opposite the vagina. In this way, in unforeseen circumstances the beast can give birth even with the appliance in place.

The container 2 has an emptying means to drain the liquid collected after the breaking of the water sacs. This means consists e.g. of a hole stopped by a cover 21. Upon removal of this cover 21 after the occurrence of an alarm, the alarm signal is cut off and the appliance is then ready to signal the start of the second phase of the mechanism of parturition: the actual dropping. This moment is detected by the moving abutment 4, as will be seen.

The moving abutment 4 is integral with an arm 41 whose free end actuates the arm of a contactor 9 fixed to the wall of the container 2. The contactor 9 is connected by an electrical lead 91 to the electrical circuit of the alarm device 7.

At the moment when the dropping begins, the feet or, as the case may be, the head of the young animal pass through the vagina of the beast 1 and immediately come in contact with the abutment 4. Under the effect of the thrust of the young animal being born the abutment 4 is pushed back towards the support 3 and the arm 41 carried with the abutment 4 then actuates the contactor 9 which releases the alarm device.

The warning device as described therefore functions from the phase preparatory to the dropping, that is from the breaking of the allantoic and amniotic sacs, and it monitors the development of the dropping. This appliance thus enables the start of the dropping to be detected safely, even if an unforeseen or abnormal situation has arisen, thus enabling losses of valuable livestock to be avoided.

Figure 4:
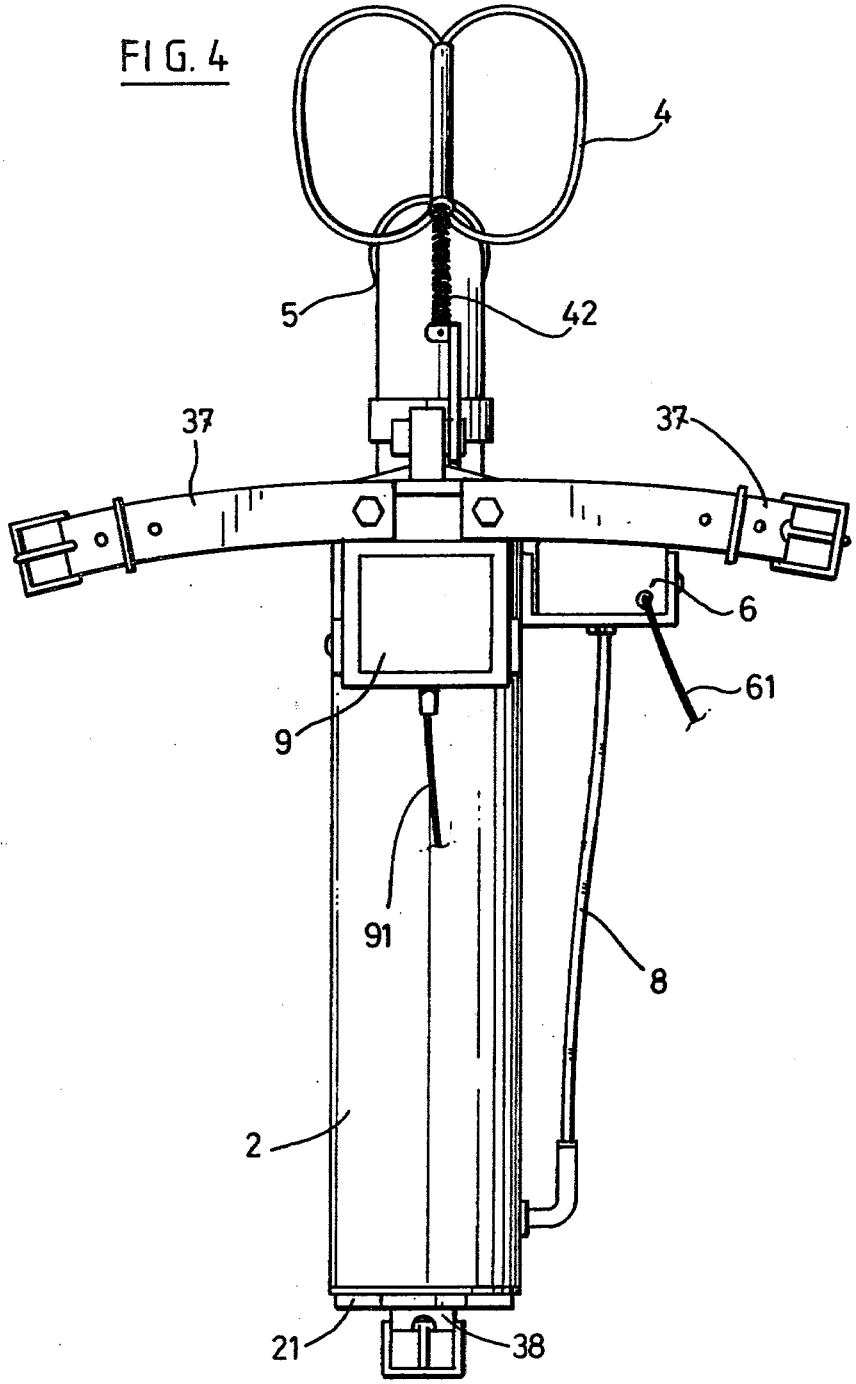
FIG. 4 is a front elevation of a second embodiment of the device according to the invention.
Figure 5:
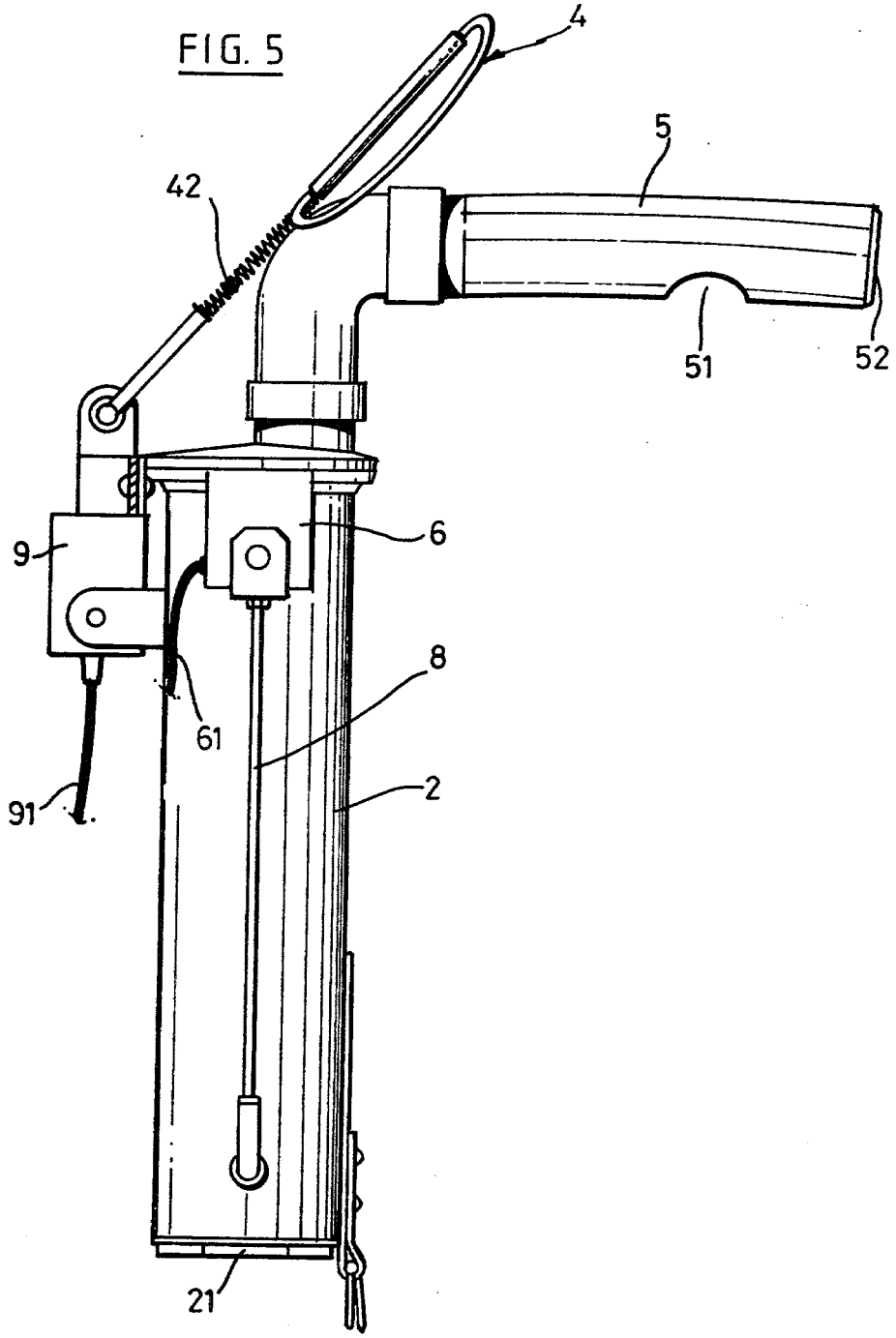
FIG. 5 is a side elevation of the device of FIG. 4.

FIGS. 4 and 5 illustrate a second exemplary embodiment of the warning device according to the invention. In this embodiment the same essential elements as in the first embodiment can be distinguished: a container 2, a moving abutment 4, a tube 5, a pressure sensor 6 and a contactor 9. The sensor 6 is carried here by the container 2, as is the contactor 9. The electrical cable 61 connects the output of the pressure sensor to the alarm device (not shown).

The moving abutment 4 is mounted pivotably on the arm of the contactor 9. The abutment 4 is fixed to this arm of the contactor by means of an arm 42 flexible in the pivoting plane, so as to enable the beast to give birth, if necessary, with the appliance placed in position. The fixing means to suspend the appliance on the rump of the beasts are constituted here by tethers 37 and 38 intended to be fixed to harnesses surrounding the tail and buttocks of the beast and held in place by e.g. a breast girdle.

What is claimed is:

1. Pre-dropping warning device intended to be attached to the behind of a beast, comprising a container with fastening means, a tube connected to the upper part of the container so as to be able to be introduced with its free end into the vagina of the beast and pressure sensor means having its input in communication with the inside volume of the container in the lower part of said container, so as to respond to an increase of pressure in the volume of the container and to generate an electrical signal for the control of an alarm device.

2. Pre-dropping warning device according to claim 1, wherein said tube has a hole in its wall.

3. A pre-dropping warning device according to claim 1, wherein said container has an emptying means.

4. A pre-dropping warning device according to claim 1, further comprising contactor means fitted to the container, the moving element of said contactor means being integral with a moving abutment means mounted so as to be arranged opposite the vagina of the beast.

5. A pre-dropping warning device according to claim 4, wherein the moving element of said contactor means is connected to said moving abutment by means of arm means pivoting in a vertical plane, said arm means being flexible in the pivoting plane.

* * * * *